US005946723A

United States Patent [19]

DiPrato et al.

[11] Patent Number: 5,946,723

[45] Date of Patent: Sep. 7, 1999

[54] STADIUM SACK

[76] Inventors: Molly L. DiPrato, 5915 Durham Rd.; Charles C. Rocco, 1559 Deep Run Rd., both of Pipersville, Pa. 18947

[21] Appl. No.: 09/089,429

[22] Filed: Jun. 3, 1998

[51] Int. Cl.[6] ..... A41B 1/12; A41D 1/12; A41D 3/08; A41D 1/00

[52] U.S. Cl. ..... 2/88; 2/69; 2/94

[58] Field of Search ..... 2/69, 69.5, 88, 2/89, 84, 94; 5/502, 484, 485, 482, 417, 420; 383/4, 6, 7, 8, 12, 15, 16; 190/1, 100; 224/101, 575, 576, 577, 153, 154, 155; 150/154, 106

[56] References Cited

U.S. PATENT DOCUMENTS

| | | |
|---|---|---|
| 2,045,784 | 6/1936 | Leve . |
| 2,242,641 | 5/1941 | Berger . |
| 2,513,074 | 6/1950 | Wolfe . |
| 2,659,404 | 11/1953 | Kelsey . |
| 2,870,464 | 1/1959 | Lalick . |
| 3,477,065 | 11/1969 | Hoover . |
| 3,477,552 | 11/1969 | Goldman . |
| 3,483,575 | 12/1969 | McCarthy . |
| 3,835,471 | 9/1974 | Lankford . |
| 3,958,274 | 5/1976 | Klauber . |
| 4,138,742 | 2/1979 | Meeks . |
| 4,188,988 | 2/1980 | Agyagos . |
| 4,190,918 | 3/1980 | Harvell . |
| 4,468,810 | 8/1984 | Longo . |
| 4,563,776 | 1/1986 | Boesen . |
| 5,048,975 | 9/1991 | Holbrook . |
| 5,390,381 | 2/1995 | Lamantia . |
| 5,414,881 | 5/1995 | Terrazas . |
| 5,467,487 | 11/1995 | Sicard . |
| 5,629,071 | 5/1997 | Feldman . |
| 5,735,004 | 4/1998 | Wooten et al. . |

*Primary Examiner*—John J. Calvert
*Assistant Examiner*—Shirra L. Jenkins
*Attorney, Agent, or Firm*—Gregory J. Gore

[57] ABSTRACT

A garment functioning as a cushion, blanket, or poncho with a hood. The garment includes a small triangular sheet, which functions as a hood, attached to a rectangular main sheet and handles attached to the top and near the center of the main sheet. The sheet assembly may be spread out as a blanket or worn as a poncho such that the triangular portion is fit over a person's head and the remaining main sheet drapes over the person's body. As the main sheet is folded, the handles meet and snap together to form a cushion and easily carried case.

10 Claims, 3 Drawing Sheets

STADIUM SACK

FIELD OF THE INVENTION

The present invention relates to a garment for use as a cushion, blanket, or poncho with a hood.

BACKGROUND OF THE INVENTION

Typically, people carry blankets, seat cushions, and ponchos to watch a game at a stadium. These items are often bulky and are difficult to carry into a stadium. To solve this problem, some of these items have become compact for carrying. Blankets are folded for ease of carrying. Ponchos are often folded up into a smaller compact case for easier packing and carrying. One example of a foldable poncho is shown in Boesen, U.S. Pat. No. 4,563,776 and Des. 291, 500. The Boesen poncho, or stadium coat, has a hood, sleeves and a zipper down the front with straps on the shoulders of the poncho. The Boesen poncho folds into a compact case with a handle and is secured by the straps previously located on the shoulders.

Similarly, cushions are folded and handles are added to ease transportation from one place to another. For example, in Harvell, U.S. Pat. No. 4,190,918, a hand-carryable folding cushion has a pair of handles for convenient carrying. Two cushions, attached to one another by a flexible inner panel, fold together in a back-to-back relationship and are secured opposite the flexible inner panel.

An example of a combination of items is found in Klauber, U.S. Pat. No. 3,958,274, which combines a poncho, mattress, or cushion. A head slot is located toward the center of a main sheet and inflatable, or rubber, tubes are provided within secondary sheets attached to the main sheet. Although, Klauber combines a cushion and a poncho, it does not fold into a compact case.

Similar to Klauber, in the present invention, a cushion, blanket, and poncho with a hood are combined into one item, and similar to Boesen and Harvell, the garment of the present invention is foldable and easily transported. Unlike the prior art, the present invention is compactible, lightweight, warm, and multi-functional.

SUMMARY OF THE INVENTION

The present invention is directed to a compact garment which functions as a cushion, blanket, or a poncho. The garment includes a rectangular main sheet of flexible material with a smaller triangular sheet, which acts as a hood, attached at the bottom corner of the main sheet. Cloth handles are attached to the top of the main sheet and near the center of the main sheet. Each handle has snaps such that when the handles are brought into alignment, they may be securely fastened by the snaps.

When the main sheet is unfolded, it acts as a blanket and a poncho. The poncho is worn by placing the triangular sheet over the head of a person and allowing the remaining main sheet to drape over the person's body. The garment also acts as a cushion when it is folded into a compact bundle. First, the main sheet is folded in half along the lengthier side of the rectangular sheet. Second, the folded main sheet is folded again lengthwise. Third, the main sheet is folded in quarters from the bottom to the top to form a square cushion. At this time, the handles will meet and can be snapped together for easy carrying, securely holding the material in its folded condition.

More specifically, the applicant has invented a convertible garment for use as a cushion, blanket or poncho, comprising:

a first sheet of substantially rectangular flexible material having a back, front, top, bottom, center and side edges, and including a second sheet of material affixed to the first sheet of material near the corner such that the space between the first and second sheets forms a hood covering the wearer's head. The first sheet of material includes two handles which are located on the sheet so that they are placed in abutting relationship for single-handed grasping when the first sheet is compactly folded. The handles preferably include attachment means such as snaps to hold the handles together and maintain the garment as a compactly folded bundle convenient for single-handed carrying by the handles. The garment may further include one or more zippered pockets on the first sheet, but is economically manufactured by including only these minimum number of structures simply sewn together.

DESCRIPTION OF THE PREFERRED EMBODIMENT

Figure 1:
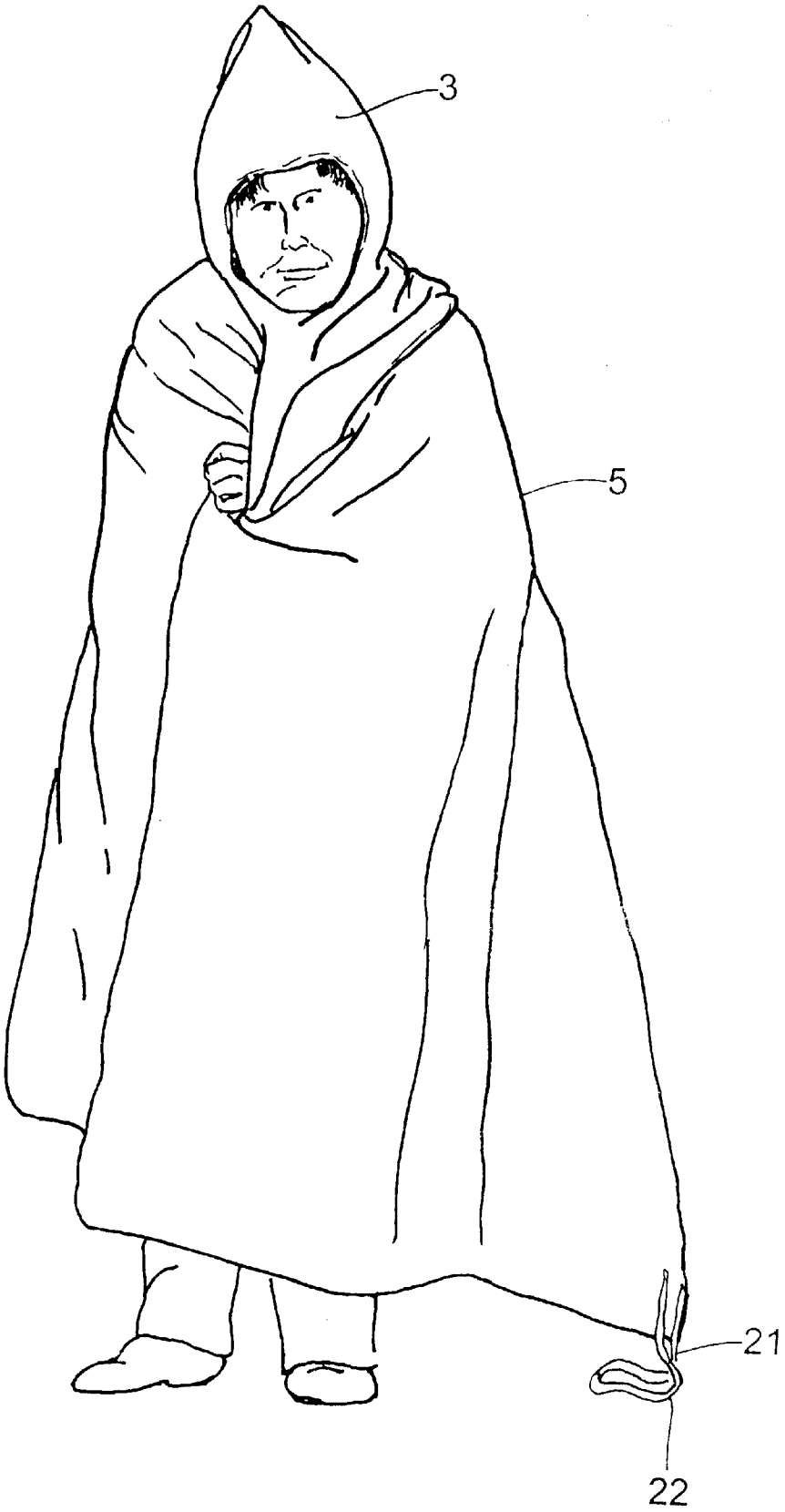
FIG. 1 is a top right front isometric view of the garment of the present invention being worn as a poncho.

FIG. 1 shows the garment of the present invention 5 worn as a poncho. As will be more fully described below with respect to FIGS. 2–7, a hood 3 is formed at a corner of the garment which covers and, hence protects, the head of the wearer from the elements. The rest of the garment is then positioned to fall comfortably over the shoulders and arms of the wearer as a full-body coverup. The handles 21 and 22 are affixed to the outside of the sheet so that they do not interfere with wearing the garment. As described further below, when the garment is folded, the handles provide convenient means for carrying the garment.

Figure 2:
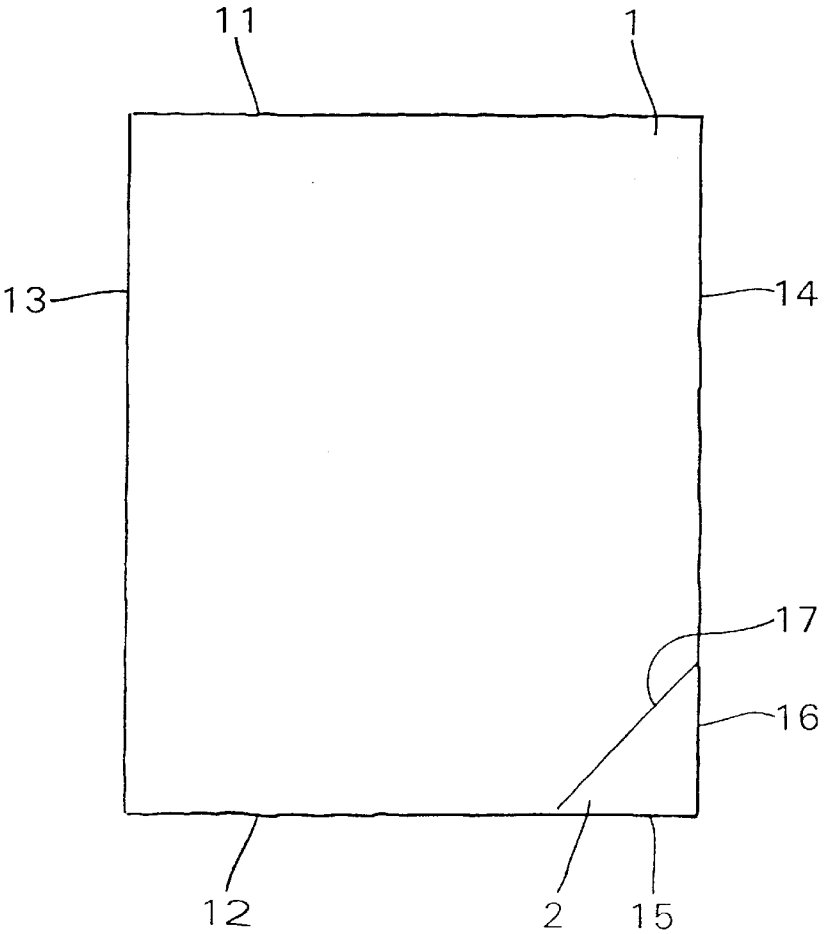
FIG. 2 is a bottom view of the garment of the present invention.

FIG. 2 illustrates the garment spread out to then be used as a blanket or a poncho. A rectangular main sheet 1 made of a flexible material or waterproof material has a top 11, bottom 12, and sides 13 and 14. The dimensions of the main sheet 1 may be 72" from top 11 to bottom 12, and 58" from side 13 to side 14. A smaller triangular sheet 2, having sides 15, 16, and 17, is attached at the bottom corner of the main sheet 1 such that sides 15 and 16 are secured to the main sheet 1 and side 17 is unattached to allow an opening. The triangular sheet 2 may be made from waterproof material. The dimensions of the triangular sheet 2 may be 16" by 16" by 22". The triangular sheet 2 acts as a hood for the poncho, where a person's head fits into side 17 and the main sheet 1 drapes over the person's body.

Figure 3:
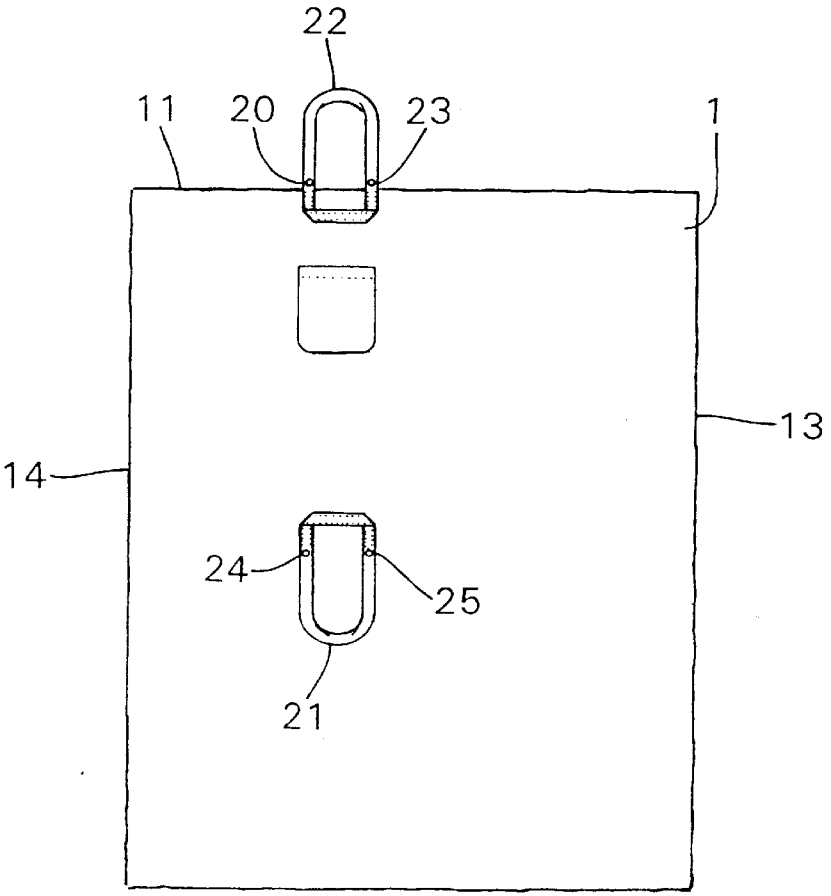
FIG. 3 is a top view of the garment of the present invention.

On the other side of the main sheet 1, as shown in FIG. 3, cloth handles 21 and 22 are attached to the top 11 of the main sheet and near the center of the main sheet. The handles 21 and 22 may be 23" cloth handles, 1¼" wide, placed 18" from one side 14 and 33" from the other side 13.

Handle 21 may be placed approximately 30" away from handle 22. Handles 21 and 22 are attached to the main sheet 1 at one end, while the other end acts as a typical handle for single-handed carrying. Handles 21 and 22 have snaps 20 and 23 and 24 and 25, respectively, such that when the handles 20 and 21 contact one another, they are securely fastened by the snaps. When fastened, snap 22 fits into snap 24 and snap 23 fits into 25.

Figure 7:
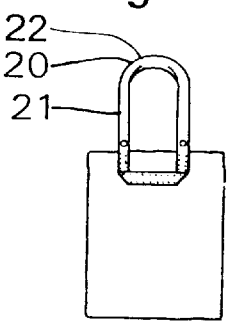
FIG. 7 is a side view of the garment of FIG. 6 folded as a compact carrying bundle.
Figure 6:
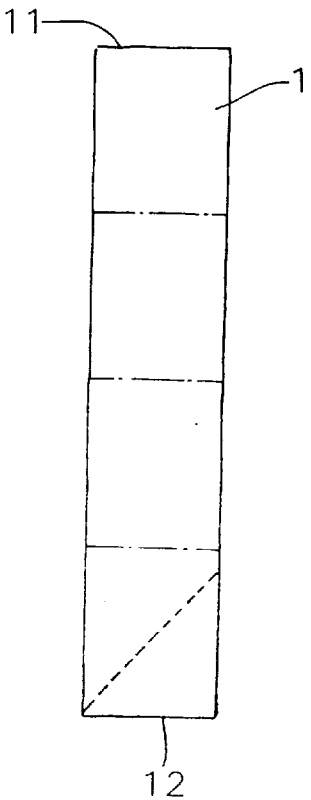
FIG. 6 is a bottom view of the garment of FIG. 5 folded in half.
Figure 5:
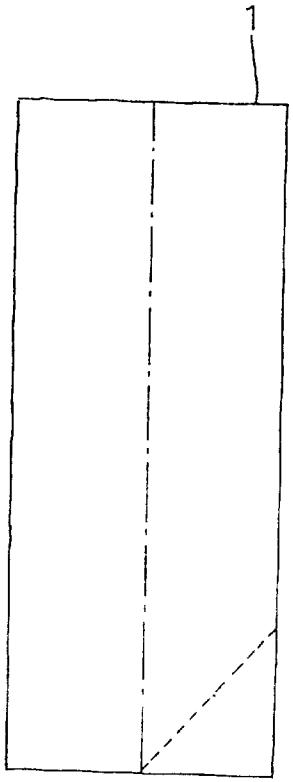
FIG. 5 is a bottom view of the garment of FIG. 4 folded in half.
Figure 4:
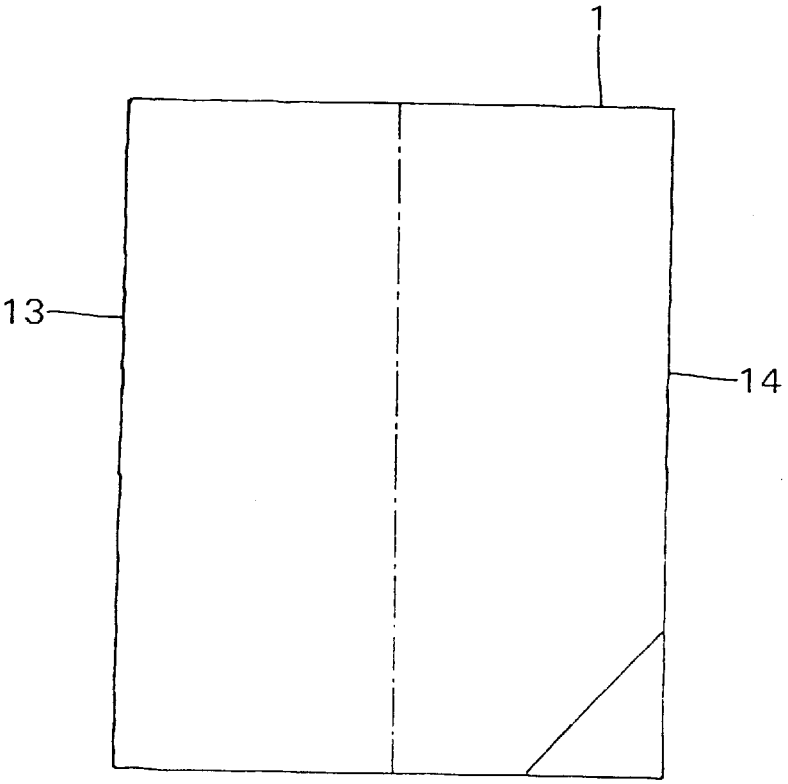
FIG. 4 is a bottom view of the garment of FIG. 3 folded in half.

As shown in FIGS. 4 through 7, the garment also acts as a cushion when it is folded into a compact bundle. First, as shown from FIG. 4 to FIG. 5, the main sheet 1 is folded in half along the lengthier side of the rectangular sheet such that the sides 13 and 14 contact each other. Second, as shown from FIG. 5 to FIG. 6, the folded main sheet 1 is folded again lengthwise. Third, as shown from FIG. 6 to FIG. 7, the main sheet 1 is folded in quarters from the bottom 12 to the top 11 to form a square cushion to sit on. In FIG. 7, the handles 21 and 22 will meet and can be snapped together for easy carrying.

Those skilled in the art to which the invention pertains may make modifications and other embodiments employing the principles of this invention without departing from the spirit or essential characteristics, particularly upon considering the foregoing teachings. The described embodiments are to be considered in all respects only as illustrative and not restrictive and the scope of the invention is, therefore, indicated by the appended claims rather than by the foregoing description. Consequently, while the invention has been described with reference to particular embodiments, modifications of structure, sequence, materials and the like would be apparent to those skilled in the art, yet still fall within the scope of the invention.

What is claimed is:

1. A convertible garment for use as a cushion, blanket, or poncho, comprising;

a first sheet of substantially rectangular flexible material, said sheet having a back, a front, a top edge, a bottom edge, a center, and side edges;

a second sheet of material affixed along a portion of a perimeter of the second sheet to the back of said first sheet along a junction of two edges of the sheets at a corner, the space between said second sheet and said first sheet forming a hood for covering a wearer's head; and a first and second handle affixed to said first sheet, said first handle attached proximate to the top edge of said first sheet and said second handle attached proximate to the center of said first sheet, said handles being located such that they are placed in abutting relationship for single-handed grasping when said first sheet is folded.

2. The convertible garment of claim 1, further including attachment means located on said first and second handles for affixing said handles together and holding said garment in said folded condition.

3. The convertible garment of claim 1, further described in that said second sheet being of a triangular shape with three sides, two of which are attached along side edges of said first sheet at a corner thereof.

4. The convertible garment of claim 2, wherein said attachment means are snaps.

5. The convertible garment of claim 1, wherein said first and second sheet is waterproof material.

6. The convertible garment of claim 1, wherein said first sheet is longer from top to bottom than from side to side.

7. The convertible garment of claim 1, wherein said handles are cloth handles.

8. The convertible garment of claim 1, wherein said first sheet is folded two times lengthwise and three times from bottom to top to form a compact carrying bundle.

9. The convertible garment of claim 1, further comprising a zippered pocket on said first sheet.

10. The convertible garment of claim 3, further described in that said garment consists only of said first sheet, said second sheet, said attachment means, and said handles, all of which are affixed together by sewing.

* * * * *